United States Patent [19]

Bald et al.

[11] 4,003,386

[45] Jan. 18, 1977

[54] DEVICE FOR SECURING TIPS TO ROD-SHAPED ARTICLES SUCH AS CIGARETTES

[75] Inventors: Hubert Bald; Helmut Demny, both of Gevelsberg, Germany

[73] Assignee: Maschinenfabrik Alfred Schmermund, Gevelsberg, Germany

[22] Filed: Apr. 14, 1975

[21] Appl. No.: 567,966

[30] Foreign Application Priority Data

Apr. 19, 1974 Austria ..... 3294/74

[52] U.S. Cl. ..... 131/94

[51] Int. Cl.[2] ..... A24C 5/58

[58] Field of Search ..... 131/94, 88, 96, 21 R

[56] References Cited

UNITED STATES PATENTS

| | | | |
|---|---|---|---|
| 2,952,105 | 9/1960 | Schur | 131/94 X |
| 3,039,373 | 6/1962 | Rudszinat | 131/94 X |
| 3,307,561 | 3/1967 | Schubert et al. | 131/94 |
| 3,420,243 | 1/1969 | McArthur | 131/94 |
| 3,527,234 | 9/1970 | Hinzmann | 131/94 |

*Primary Examiner*—John F. Pitrelli
*Attorney, Agent, or Firm*—Sughrue, Rothwell, Mion, Zinn & Macpeak

[57] ABSTRACT

A device for attaching filter tips to cigarettes is disclosed. The device comprises a rotatable grooved drum provided with a plurality of peripheral recesses each adapted to hold an assembly consisting of a double length tip component and two axially aligned cigarettes disposed to abut against respective end surfaces of the tip component, a feeder to feed successive connecting sheets each provided with an adhesive coating on one surface to overlie the respective recesses in the grooved drum. The sheets each extend asymetrically of the center of the respective recess with the coated surface facing outwardly of the drum. Such assemblies are successively urged into respective recesses as the grooved drum rotates and the respective connecting sheets are thereby partially wrapped around the peripheries of the respective assemblies. Guide means are mounted in such juxtaposed relationship with the periphery of the grooved drum that, as the grooved drum rotates, a free end portion of each connecting sheet is so folded by interaction with the guide means as to cause the one surface of the free end portion to be disposed in mutually facing relationship with the peripheral surface of the grooved drum. The partially wrapped assemblies are then successively ejected from the recesses of the grooved drum each to be received by the respective recess defining means of further carrier means, which is displaceable in co-ordination with the movement of the grooved drum. Each recess defining means of the further carrier means is adapted to press the free end portion of the respective connecting sheet against the respective assembly.

20 Claims, 4 Drawing Figures

53
71 49
50
52
70
43
47 48 51
127
42
46
44 45
13 61
69
64
29
12
125
126
30
68
31
38
37
41
34
35 23
40 39
27
124
24
22
36
66
67
62 63
60
9
8
26
21
25
65
28
15
11
6
19
20
56
7
54
5
58
10
57
4
16 18
17
14
128
1
59 2
32
33
3 55
129

DEVICE FOR SECURING TIPS TO ROD-SHAPED ARTICLES SUCH AS CIGARETTES

BACKGROUND OF THE INVENTION

The present invention relates to a device for securing tips to rod-shaped articles such as cigarettes by wrapping the junction between a tip member and the body of a cigarette with a connecting sheet and adhesively bonding the inner face of the sheet to the body and to the tip member.

A device of this type usually has offered to it assemblies each consisting of a cigarette on each side of a tip member of double the usual length. In the device, the entire tip and the immediately adjacent region of each cigarette is wrapped with a connecting sheet, the longitudinal edges of which overlap each other, usually around a very short section of the circumference. After the joint has been made, the assembly is divided in the middle, after adhesive on the inner face of the sheet has hardened.

A number of known devices posses a grooved drum, upon the periphery of which grooves, suited to the shape of cigarettes, extend parallel to its axis. The assemblies or groups are pressed into these grooves, with the sheets beneath them, so that after a first step in the wrapping operation has taken place, the free ends of the sheets will have to be folded over from the two sides and pressed down.

One known machine for carrying out this second step is provided with a grooved drum in which radially movable flaps are incorporated. These flaps are lifted out under the control of camming means and are displaced so as to fold over the edges of the sheets from the two sides in succession under the action of stressed springs. Quite apart from the extraordinarily complicated construction of such a device, its principal disadvantage is that the flaps must immediately be moved in again. In a rapidly operating machine, the pressing time is not sufficient for the adhesive to harden, so that the joint can become loose again.

In another known machine, a second drum revolves in the same direction as and synchronously with a grooved drum, having upon its circumference closure members, intending for pressing one flap onto the group and for orienting the other sufficiently far for pressing on for a fixed pressing member, disposed after it in the direction of rotation, to be able completely to press on the still free flap. In this arrangement, the pressing-in of the first laid flap takes place only during a very short instant, and in this case also reliable adhesion is not possible where the machine operates rapidly.

Finally, a machine is known in which the connecting sheets initially lie asymetrically relative to the centre of the groove, when the group is pushed in. There therefore remains still one freely projecting flap, which is moreover longer than with the other solutions referred to. In this known device, the free flap remains bearing against the circumference of the grooved drum, until the partially wrapped group is ejected. At this position of the circumference, a closure drum equipped with a soft elastic facing, is mounted to rotate in the same direction at a higher peripheral speed than the grooved drum. Interaction between the group and the soft elastic facing of the closure drum causes the group to be over the rolled flaps, after which the group is ejected. The construction of this device is relatively simple, but the results which can be achieved are not satisfactory; on the one hand the wrappings are non-uniform, indeed even undulating, while on the other hand the period of pressing-in is still not adequate for complete hardening of the adhesive.

Here it should be remembered that two types of adhesive are used; firstly, conventional water-soluble glues, which are applied onto the sheets before they are processed, and on the other hand heat-activated adhesives, with which the sheet material is coated in the first place and which, just before the wrapping and adhesive bonding operation, must be activated by being heated. During the hardening operation therefore, pressure must be applied with the first type until the moisture has evaporated, and with the other type until the applied heat has been removed; in the latter case therefore, the device must act as a "heat-sink".

SUMMARY OF THE INVENTION

According to the present invention, there is provided a device for securing tips to rod-shaped articles, comprising a rotatably mounted carrier drum adapted to carry a plurality of assemblies each comprising a tip component and two axially aligned such rod-shaped articles disposed to abut against respective end surfaces of such tip component, a grooved drum rotatably mounted and provided with a plurality of recess defining means disposed at intervals around the periphery of the grooved drum, each recess defining means defining a respective axially extending recess in the periphery of the grooved drum, feeder means adapted to so feed successive connecting sheets towards the peripheral surface of the grooved drum that each such sheet overlies a respective one of the recesses to extend assymetrically relative to the centre of the respective recess and to be disposed with one surface thereof facing outwardly of the grooved drum, urging means provided on the carrier drum to urge such assemblies carried by the carrier drum into the recesses in the grooved drum such that, on such assembly being urged into the respective one of said recesses, a respective one of such connecting sheets is partially wrapped around the periphery of such assembly, guide means mounted in such juxtaposed relationship with the periphery of the grooved drum that, on rotation of the grooved drum, a free end portion of such partially wrapped connecting sheet is so folded by interaction with the guide means as to cause said one surface of the free portion to be disposed in mutually facing relationship with the peripheral surface of the grooved drum, ejector means operatively associated with the grooved drum to eject partially wrapped assemblies from the recesses, and further carrier means displaceable in co-ordination with the rotation of the grooved drum and provided with a plurality of further recess defining means each defining a recess adapted to receive respective ones of such partially wrapped assemblies ejected by the ejector means from the grooved drum, the further recess defining means being adapted to press the free end portion of the connecting sheet against the assembly.

If a glue is used which sets when heat is removed, the drums do not act as cooling elements, but are heated in those regions in which groups are introduced, but are kept cool in the regions where the sheets are situated without a group.

Preferably, the further carrier means comprises a closure drum mounted on said frame to be rotatable in coordination with said grooved drum.

On the one hand, the boundary walls of the grooves in the two drums must exert a certain applied pressure, but on the other hand the groups must not be damaged during transference. This can be allowed for in various ways: either be very exact shaping of the groove cross-section with suitable rounded portions and/or by an elastic flexibility of one or more groove wall regions or, finally, by regulated opening and closing of the grooves in such a way that the transference takes place without the need to overcome fairly large frictional forces, followed by a predetermined applied pressure due to the inward swinging of one of several sections of the wall.

BRIEF DESCRIPTION OF THE DRAWINGS

Embodiments of the present invention will now be more particularly described with reference to the accompanying drawings, in which.

DESCRIPTION OF PREFERRED EMBODIMENT

Figure 1:
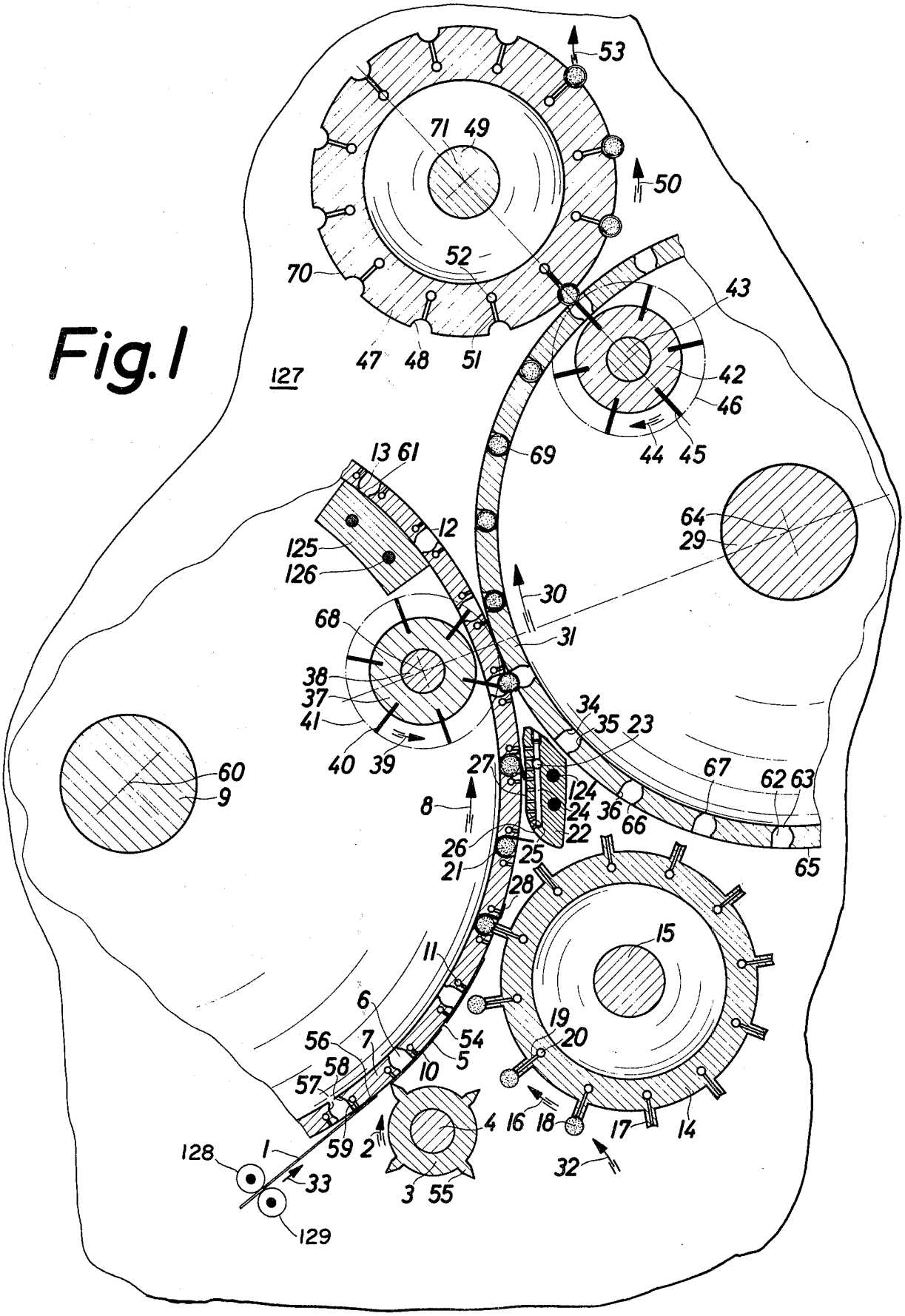
FIG. 1 shows a sectional view of a device for securing tip members to cigarettes in accordance with a first embodiment of the invention.

Referring now to the accompanying drawings, FIG. 1 shows a device in which a cutting roller 3 is journalled on a shaft 4 so that it can be driven in the direction of arrow 2. The blades of knives 55 co-operate with the cylindrical surface 54 of a first grooved drum 7, which can be driven in the direction of arrow 8 on a shaft 9. The drum 7 posesses, around its circumference at uniform intervals, groove-shaped recesses 6, which extend transversely to the direction of conveying and parallel to each other in the cylindrical surface 54. The grooves 6 are longer in the axial direction than the largest length of the groups which are to be processed. They serve both for transporting and also for partially wrapping the groups, whereby pressing-in of the connecting sheet lasting for a fairly long period is provided for, in order to ensure reliable adhesion.

The lateral pressing surface regions 57 and 58 of the grooves 6 are cylindrical in cross-section, whereas the lateral pressing surface regions 59 are flat and extend approximately parallel to a radius passing through the axis of rotation 60 and the centre of the groove, i.e. they extend generally radially of the drum 7.

The edges defined by the lines of intersection of the pressing surface regions 57 and 59 with the cylindrical surface 54 are rounded areas 12, thus facilitating the introduction of groups into the grooves.

At the base of each groove 6 facing inwardly towards the axis of rotation 60 apertures 61, bounded by lateral surfaces 13, extend over the entire length of the grooves and lead into the interior of the hollow drum 7.

A band 1, drawn from a storage roller (not shown) endlessly by means of two mutually co-operating pulling rollers "128 and 129" in the direction of arrow 33, runs tangentially onto the drum 7 at 56, and is subdivided into connecting sheets 5 of equal length in known manner by the linear contact on the cylindrical surface 54 of the cutting edges of the knives 55, revolving at the same peripheral speed as that of the drum 7.

A speed is imparted by the pair of pulling rollers 128 and 129 to the band 1 running tangentially onto the drum 7, which is slightly less than the peripheral speed of this drum 7. This enables spacings to be created between the separate connecting sheets 5.

Where a wet adhesive is used, a thin coating of adhesive is applied by a pasting device (not shown), onto the surface of the band 1 which faces away from the drum 7 before the band is cut; where a heat-activated adhesive is used, this is already present on the band when supplied.

The still uncut band 1 is held onto the cylindrical surface 54 by suction holes 10 disposed on either side of the grooves 6.

The axial passages 11 communicating with the suction holes 10 can be connected successively by a fixed control disc (not shown) with vacuum or compressed air sources.

A conveying drum 14, furnished with radial ribs 17, is journalled on a shaft 15 so as to rotate in the direction of arrow 16. The ribs 17 are equipped at their outer ends with grooves, the surface of which lie on a circular cylinder. The pitch circle of the conveying drum 14 is defined by the center point of this circular cylinder. The pitch circle of the drum 7 defined by the center points of the grooves 6 touches the pitch circle of the conveying drum 14. The rotational speeds of the two drums are so adjusted that the peripheral speeds at the pitch circle are of equal value.

In the direction parallel to the rotational axis of the conveying drum 14, the ribs 17 are of a length which exceeds the maximum length of the groups 18, which each comprise a pair of cigarettes on either side of a double tip (such as a filter) fitting tightly and coaxially to it.

The groups 18 supplied to the conveying drum 14 from a further conveyor (not shown) in the direction of arrow 32 are held on the ends of the ribs 17 by suction, which is applied through the axis-parallel passages 20 and passages 19 from a vacuum source, being switched off and on by a control ring, not shown, The groups 18, during the course of their trans-axial conveying, are transferred into the grooves 6 of the grooved drum 7. The connecting sheets held by suction on the cylindrical surface 54 are thereby partially pressed into the grooves 6, thus causing them to wrap the groups 18 over the length corresponding to that of the connecting sheets 5.

The groove mouth formed by the two rounded surfaces 12 of the groove 6 is narrower than the diameter of the groups 18. This causes therefore a certain deformation of the groups. By the deformation forces acting on the rounded surfaces 12, a tight wrapping of the connecting sheets around the groups is effected. The constriction of the groove mouth also leads to a firm holding of the groups in the grooves, without additional auxiliary means such as suction air.

The position of the connecting sheet upon the cylindrical surface 54 of the drum 7 is so determined in the circumferential direction that, considered in conveying direction 8, the rear end of the connecting sheet 5 comes completely into bearing against the cylindrical surface of the group 18, in such a way that in every case it bears against the cylindrical portion of the pressing surface region 57 of the grooves 6. During the pressing -in of the groups 18 into the grooves 6, the projecting, front, free end 28 of the connecting sheet remains held by suction force onto the cylindrical surface 54, although some displacement in a direction opposite to that of conveying can take place, which can be tolerated.

When further trans-axial conveying of the thus formed and partially wrapped groups 21 upon the drum 7 takes place, the vacuum applied to the passages 10 is switched off and replaced by compressed air. The front end 28 of the connecting sheet thereby becomes loosened from the cylindrical surface 54 and stands up, so that it projects in an approximately radial direction from the cylindrical surface 54.

In this postion, it can be seized by the convex wrapping surface 26 of the fixed guide piece 22, which serves as a preparation member, and can be wrapped around. The concave guide surface 27 of the guide piece 22, which follows the convex wrapping surface 26, is a portion of a circular cylinder about the centre point 60. This guide surface has the function of guiding the end 28, which has been folded over by the convex surface 26, of the connecting sheet during the further trans-axial conveying of the partially wrapped groups 21, in such a manner that firstly there is no contact of the front end 28 of the connecting sheet which has its pasted surface towards the drum 7 with the cylindrical surface 54, and secondly that a certain tensile force is exerted upon the leading end 28 of the connecting sheet opposite to the direction of conveying, in order to prevent the formation of folds by the connecting sheets during the subsequent complete wrapping of the groups.

This is achieved by the exerting of a suction action upon the wrapped-around end of the connecting sheet, by means of the guide surface 27. This suction effect is achieved by a number of suction holes 25, which are connected by the longitudinal passage 24 and transverse passage 23 to a suction source (not shown).

The closure drum 31, drivable about a shaft 29 in the direction of arrow 30, is equipped like the drum 7 around its periphery with grooves 62 parallel to the drum axis and extending axially for a length exceeding that which would be necessary for the maximum length of the groups 21.

The grooves 62 serve for receiving and completely wrapping the partially wrapped groups 21, and also for pressing the front end 28 of the connecting sheet onto the group for a period sufficiently long to ensure reliable adhesion.

The lateral pressing surface regions 34 and 35 of the grooves 62 are formed cylindrically, whereas the lateral pressing surface regions 36 constitute a flat surface, which is approximately parallel to a radius extending through the axis of rotation 64 and the center of the groove.

The edges defined by the lines of intersection of the pressing surfaces 35 and 36 with the cylindrical surface 65 of the drum are rounded surfaces 66, so that the introduction of the partially wrapped groups 21 into the grooves is facilitated. At the bases of the grooves 62 towards the center 64 of the closure drum, openings 63 bounded by lateral surfaces 67 and extending along the entire axial length of the grooves lead into the interior of the hollow drum 31.

The mouth of the groove formed by the rounded surfaces 66 is narrower than the diameter of the groups 21. This leads to a tight wrapping around of the connecting sheet, and also to secure holding during the trans-axial further transporting of the groups 69, now completely wrapped with the connecting sheets.

The circumferential speeds of the drums 7 and 31 are equal at their cylindrical surfaces 54 and 65 respectively. The phase position of the grooves in the drums 7 and 31 are so selected that the grooves are exactly opposite to each other at the contact point between the cylindrical surfaces 54 and 65.

An ejector wheel 37, drivable about a shaft 38 in the direction of arrow 39, is provided for effecting transference. It is equipped at its circumference with a number of spokes 40, arranged at uniform intervals and having an axial length in a direction parallel to the rotational axis exceeding the maximum length of the groups 21, partially wrapped with a connecting sheet. The rotationsl speed and angular position of the ejector wheel 37 and the circumferential dimensions of the spokes 40 are so selected that, during the synchronous rotation with the drum 7, the spokes 40 project through the apertures 61 into the internal space of the grooves 6 and project out without contacting parts of the grooved drum 7 itself. The external ends of the spokes 40 describe a circle tangential to the cylindrical surface 65 of the closure drum 31. The groups 21, partially wrapped with a connecting sheet, are thereby pushed by the blades 40 of the ejector wheel 37 in the region of the contact line between drums 7 and 31 out of the grooves 6 of the ground drum 7 into the opposite grooves 62 of the closure drum 31.

In this operation, the not yet applied front flap 28 of the connecting sheet is folded, by the curved surface 66 adjoining the pressing surface 35, completely around the partially wrapped group 21 and, after complete entry into the groove 62, is pressed by the pressing surface 35 firmly against the group and over the other end of the connecting sheet in the overlap region. The pressing force is principally determined by the amount by which the circular cylinder determined by the pressing surface rebions 34 and 35 is less than the diameter of the group.

In the subsequent trans-axial conveying of the group 69, completely wrapped with a connecting sheet, a reliable gluing-together of the pasted regions takes place, especially at the postion of overlap between the two ends of the connecting sheet, as a result of the high applied pressure and the time which is available for applying it.

The removal drum 47, driven in the direction of arrow 50 about a shaft 49 having an axis 71, possesses around its circumference at uniform intervals axis-parallel, semi-circular receiving grooves 48, which have a greater axial length then the maximum length of the groups 69 which are wrapped and glued by a connecting sheet. The center points of the semi-circular grooves 48 lie on a pitch circle, situated in the external cylindrical surface 70 of the removal drum 47. The angular position of the semi-circular grooves 48 is so adjusted that they lie exactly opposite to the grooves 62 of the closure drum 31 upon the connecting line between the axes 71 and 64. In this position, the cylindrical surface 70 is at such a distance from the cylindrical surface 65 that a group 69, transferred into a semi-circular groove 48, still projects somewhat into the groove-shaped recess 62, but not longer touches the rounded surfaces 66 of that groove. The groups 69 are held in the semi-circular grooves 48 by suction, which can be applied through the suction holes 51, which can be connected by longitudinal passages 52 to a vacuum source, not shown, around a specific angle of rotation of the removal drum 47, by means of a control plate, not shown here. From the removal drum 47, the group 69 can be transferred in the direction of arrow 53 to a further conveying means, not shown.

The transference of the groups 69 is effected by an ejector wheel 42, which is driven in the direction of arrow 44 about a shaft 43 and which is provided with spokes 45, which co-operated with groups in the grooves of the drum 31 in the same manner as described for the co-operation of ejector wheel 37 and grooved drum 7. The circle described by the radial endes of the spokes 45 however lies inside the cylinder defined by the cylindrical surface 65, in such a manner that it just touches the group 69, situated in the semi-circular groove 48, along a generatrix.

It is thereby possible, as the groups 69 conveyed trans-axially in the closure drum 31 approach the removal drum 47, to push them out by means of the blades 45 from the grooves 62 and to transfer them into the semi-circular grooves 48 of the drum 47.

If a heat-activated adhesive is used, this adhesive must be activated by the application of heat. In this case, there is associated with the conveying drum 7 a heat sources 125 and 126, which effects heating of the drum to the necessary activation temperature in the appropriate circumferential regions, thus causing the connecting sheets 5 to reach the activation temperature. In order to ensure that the adhesive on the front flaps 28 of the connecting sheets also retains a sufficiently high temperature, after lifting from the cylindrical surface 54 up to the instant of complete wrapping around by the rounded surface 66 of the grooves 62, the guide piece 22 is brought to a correspondingly high temperature by a further heat source 124 on the concave guide surface 27, so that by contact with the guide surface, renewed heating of the adhesive takes place.

The necessary removal of heat is effected, after transference of the groups 21 (and the associated complete wrapping of the connecting sheets) into the grooves 62, by the surrounding air and by the metallic contact with the pressing surfaces of the grooves 62. Satisfactory hardening of the adhesive is effected here, especially for the critical positons of overlap between the ends of the connecting sheet, by the contact with the metal of the closure drum 31, acting as a "heat sink".

As shown in FIG. 1, two heater cartridges 124 are arranged within the guide member 22 to enable the guide member to be heated up. Thereby, when using a heat-activated adhesive substance, the forward lobe 28 of the connecting paper can likewise be heated up at the guide surface 27, a re-activation of the melting adhesive substance then occuring.

Arranged to be stationary in the interior of the "mould" drum 7 is a heater element 125 which in its turn is heated up by two heater cartridges 126. The "mould" drum 7 is uniformly heated up by heat radiation and convention during its passages past the heater element 125. Thereby, on use of a melting adhesive substance, a re-activation is attained of the melting adhesive substance disposed on the connecting paper. The rollers 128 and 129 are supported by their shafts in a frame 127, as are the shafts 4, 9, 15, 29, 38, 43 and 49. The guide member 22 is also secured to the frame 127.

The method of action of the device which has been described above with reference to FIG. 1 will be briefly summarized as follows:

The already pasted band 1, drawn from an endless roll by a pair of pulling rollers "128 and 129" is supplied tangentially in the direction of arrow 33 to the grooved drum 7 and is subdivided on its cylindrical surface 54 into connecting sheets 5 of equal length of a cutting roller 3, revolving in the direction of arrow 2 in a manner which is co-ordinated with the speed of rotation of the drum 7 and at the same circumferential speed as that of the cylindrical surface 54. The paste coating is situated on the side towards the cutting roller.

As a result of a slight difference in the feed speed of the band 1 and the circumferential speed of the cylindrical surface 54, specific spacing occur between the individual connecting sheets. Holding of the connecting sheets 5 on the cylindrical surface 54 is effected by the suction holes 10, which can be subjected to either vacuum or compressed air through specific angles of rotation of the conveying drum 7, by means of control discs 119 and 122 (FIG. 2).

Tip-cigarette groups 18 are supplied to the conveying drum 14, revolving about the shaft 14 synchronously with the grooved drum 7 in the direction of arrow 16, from a further conveying means, not shown, in the direction of the arrow 32; these groups are received by the blades 17 in circular grooves and are held by means of the suction ducts 19 and vacuum. When the groups 18 approach the grooved drum 7, they are introduced into grooves 6, and the connecting sheets are simultaneously partially wrapped around the groups. The trailing ends with respect of conveying direction 8 of the respective connecting sheets, determined by a specific starting position of this connecting sheet upon the cylindrical surface 54, now comes to bear upon cylindrical pressing surface regions 57 of the groove, while the front end 28 of the connecting sheet still rests upon the cylindrical surface 54 and is held there by suction force.

Figure 2:
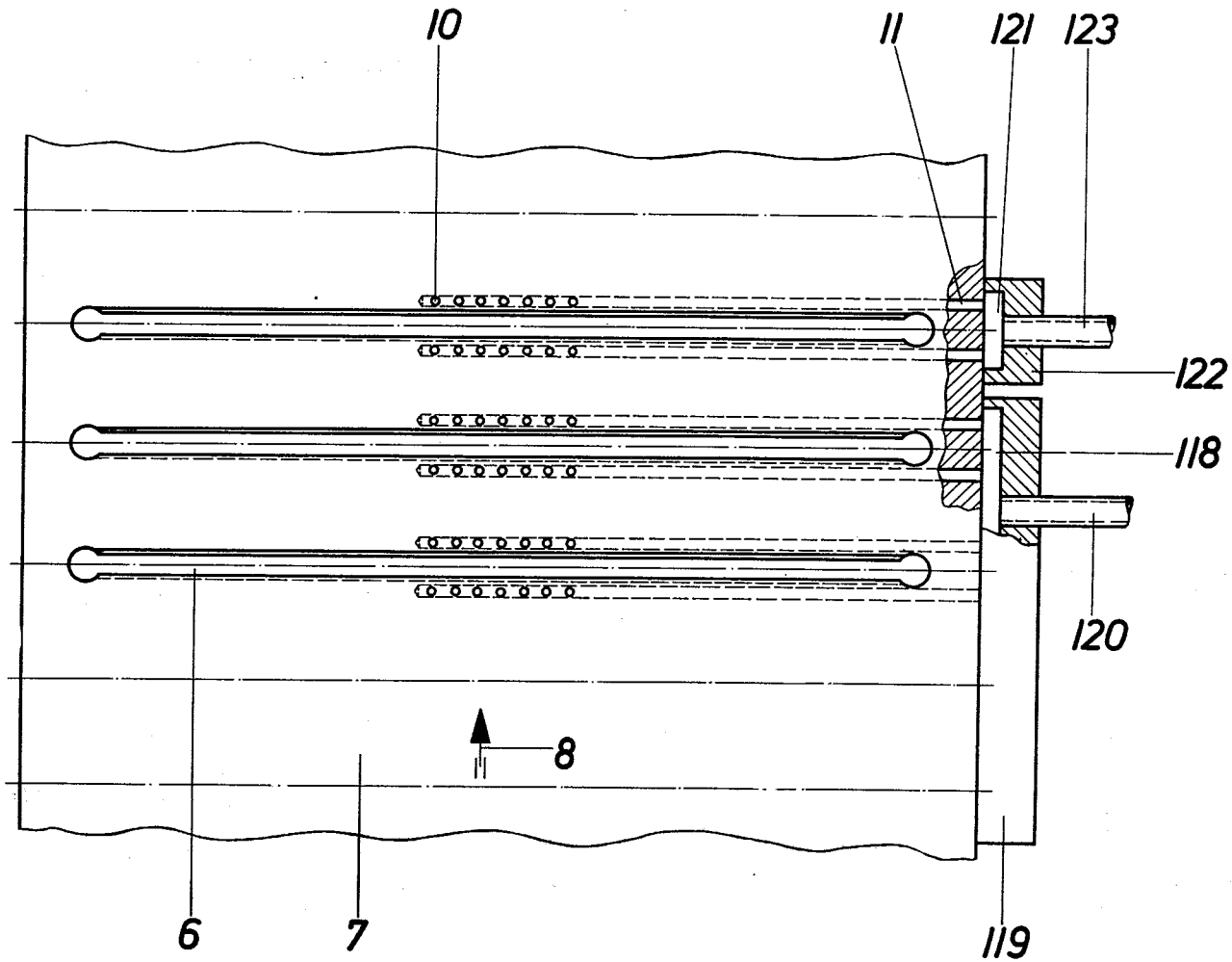
FIG. 2 shows a view of part of the circumferential surface of a drum shown in FIG. 1, together with control means for applying suction or compressed air to grooves provided in the drum surface.

As soon as the groups 18 have been completely transferred into the grooves, the vacuum at the suction ducts 10 is switched off, this being done by control discs 119 and 122 (FIG. 2).

Since the diameter of the partial circular cylinder formed by the pressing surface regions 57 and 58 is smaller than the diameter of the groups 18 with the connecting sheet laid partially around, a strong pressing force acting over a fairly long period results, leading to reliable adhesion. At a certain distance from the transfer point, the front ends 28 of the connecting sheets are loosened from the cylindrical surface and raised up. This is done by the suction passages 10 being subjected to compressed air, instead of vacuum, by means of a control ring, not shown.

During the further trans-axial conveying of the groups 21 by means of the drum 7, these groups pass, without being held by any means other than clamping, by the fixed guide piece 22. In doing this, the raised front ends or free flaps 28 of the connecting sheets, are folded over by the folding surface 26 against the conveying direction and are held by the guide surface 27 in this position. By means of the suction holes 25, a bonding effect is obtained of the connecting sheets onto the folding surface and guide surface, and it is ensured that the connecting sheet does not come into contact at its pasted side with the cylindrical surface 54 and simultaneously is stretched. As the groups 21 approach the closure drum 31, they are pushed by the spokes or blades 40 of the ejector wheel 37 revolving about the shaft 38 in the direction of arrow 39 synchronously with the grooved drum 7, into the grooves 62 of the closure drum 31. The front ends 28 of the connecting sheets are thereby folded by the rounded surfaces 66, adjacent to the pressing surface region 35, of the grooves 62 completely around the groups 21, and come into contact with the cylindrical pressing surface region 35 under a specific application pressure.

This application pressure is produced by the fact that the diameter of the groups 69, completely wrapped with the connecting sheets, is greater than the diameter of the cylinder defined by the cylindrical pressing surface regions 35 and 34.

The application pressure is maintained during the entire subsequent conveying of the groups 69 in the drum 31 and has the effect of producing reliable adhesion especially at the critical overlap positions of the connecting sheets, and also of reliably holding the groups in the grooves.

As the groups 69, which meantime become reliably glued, approach the removal drum 47, they are ejected out of their grooves by the spokes or blades 45 of the ejector wheel revolving about the shaft 43 in the direction of arrow 44 synchronously with the drum 31, and are received and further conveyed by the semi-circular grooves 48 of the removal drum 47, revolving about a shaft 49 synchronously with the drum 31, in order that they may finally be transferred in the direction of arrow 53 to a further conveying means, not shown, for further processing. The holding of the groups 69 in the grooves 48 is effected by suction air, which is applied by a control ring, not shown, from a vacuum source, not shown, to the suction openings 51 through a specific angle of rotation.

FIG. 2 shows a plan view of the "mould" drum 7 perpendicularly to its axis 60. On the "mould" drum rotating in the direction of the arrow 8, one recognizes the moulds (hollows, troughs) 6, the suction bores 10 for the retention of the connecting papers and the axial bores 11 communicating with the suction bores.

The stationary control disc 119, provided with the control slot 118, is connected by the feed duct 120 with a not shown vacuum source. The stationary control disc 122, provided with the control slot 121, is connected with a not shown source of compressed air.

On rotation of the mould drum 7 in direction of the arrow 8, the axial bores 11 are initially connected with the vacuum source. Thereby, an adhesion of the connecting papers to the mould drum is attained. Consecutively, the axial bores 11 are connected with the source of compressed air after the pushing in of the groups into the moulds 6. Thereby, an erection of the forward lobe 28 of the connecting paper is attained.

Thus, FIG. 2 indicates how the axial bores 11, which communicate with the suction bores 10, are alternatingly connected by two stationary control discs with sources of vacuum and compressed air.

Figure 3:
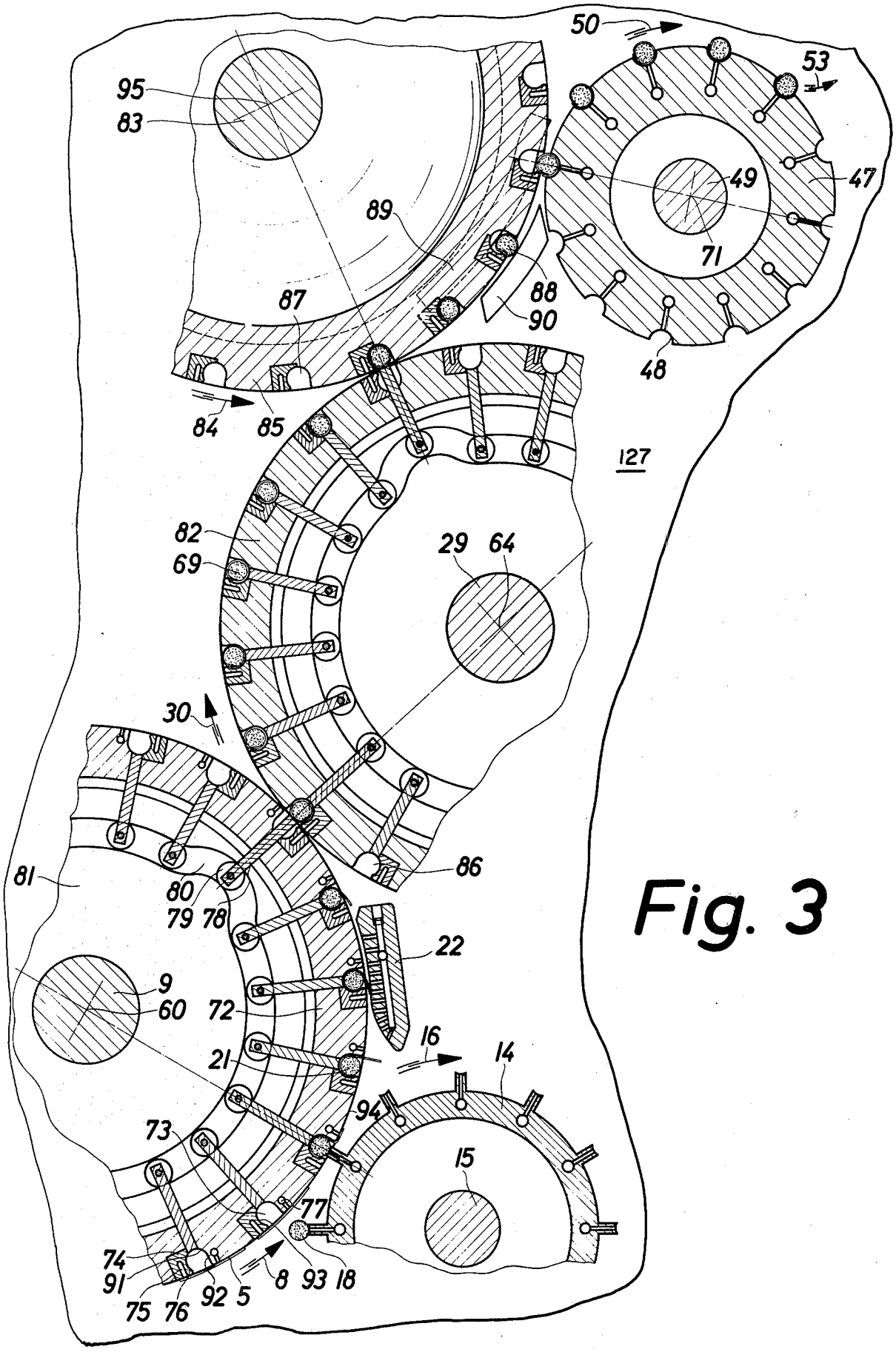
FIG. 3 shows a sectional view of a device for securing tip members to cigarettes in accordance with a second embodiment of the invention.

FIG. 3 shows a second example of embodiment of the subject of this invention.

The basic details in which this differs from the device according to FIG. 1 are as follows:

A grooved drum 72, closure drum 82 and an intermediate drum 85 are formed by the contours of two differing parts. While pressing surface regions 91 and 92 are formed similarly to the pressing surface regions 58 and 59 of the grooved drum 7 according to FIG. 1, by a special shaping of the surface of the grooved drum 72, pressing surface regions 93 are formed by the shaping of special strips 74, let into the cylindrical surfaces 94 of the drums 72, 82 and 85. These strips 74 extend over the entire axial length of the grooves 73 and are furnished with a slit 75, extending along their entire length. This enables the remaining web 76 to spring away, in order to facilitate the acceptance of the groups 18, 69 and 88 respectively, and in order to exert a defined pressure upon the groups.

The ejector wheels 37 and 42 of the device according to FIG. 1 are replaced, in the embodiment according to FIG. 3, by the plungers 78, revolving with the drums, which have a longitudinal dimension in the direction parallel to the axes 60 and 64 which is approximately equal to the length of the groups to be handled. These plungers 78 are radially movable by about the amount of the diameter of one group and are each driven by two cam rollers 79, of which only the rear one can be seen in FIG. 3. The guiding of the cam rollers 79 is effected by the inner and outer flanks of a groove 80, let into a fixed disc 81. By the special shape of this groove 80, the groups 21 and 69 can be ejected by means of the plungers 78 from the groove 73 and transferred into the grooves of the next adjacent drum.

The outward guiding of the groups 88, introduced into the groove-shaped recesses 87 of the intermediate drum 85 which can be driven about a shaft 83 in the direction of arrow 84 synchronously with the closure drum 82, is effected by inner guides 89 and outer guides 90, which are mounted fixed in a manner not shown. The stationary inner guides 89 penetrate into annular grooves, not shown, of the rotatable define ramp surfaces which on rotation of the drum 85 interact with intermediate drum 85, in order to the groups 88 and urge such groups out of the grooves 87. The outwardly facing guide surface of the inner guides between the central axes 95 and 71, are situated with their center points upon the pitch circle of the semi-circular grooves in the removal drum 47 and are thus transferred to them. The frame of the device is shown at 127 in FIG. 3.

The method of action of the example of embodiment according to FIG. 3 corresponds substantially to the method of action of the example of embodiment according to FIG. 1. The difference are as follows:

The ejection of the groups 21, 69 respectively from the grooves of the grooved drum 72 and closure drum 82 is effected not be revolving ejector wheels, but by plungers 78, which revolve with the drums and can be displaced by cam rollers 79.

The complete wrapping and gluing of the groups takes place in the grooves 86 of the closure drum 82. Whereas, however, according to FIG. 1 the completely wrapped and glued groups 69 are transferred by the closure drum 31 into th semi-circular grooves of the removal drum 47, in the case of FIG. 2 the groups 69, completely wrapped but possibly not yet completely glued in the closure drum 82 are transferred into the grooves 87 of the intermediate drum 85. Since the grooves 87 are of the same geometrical shape as the grooves 86, a further hardening of the glued positions can take place in this case during the further trans-axial conveying of the groups 88 into the grooves 87. This additional hardening of the glued positions may, where water-containing wet glue is used, be effected by the supply of heat or, where a heat-activated adhesive material is used, be effected by especially intensive cooling. The means for supplying or removing heat are not shown in FIG. 3 for the sake of clarity.

The transference of the groups 88 from the intermediate drum 85 to the removal drum 47 corresponds to the transference of the groups 69 from the closure drum 31 to the removal drum 47 according to FIG. 1, but with the difference that in the second example of embodiment, the groups 88 are transferred by the action of internal guides 89 instead of by an ejector wheel to the drum 47.

The construction of the device according to FIG. 4 resembles that of the device which has been described with reference to FIG. 1.

The basic differences are as follows:

The grooved drum 72, drivable about the shaft 9 in the direction of arrow 8, corresponds to the drum 72 in FIG. 3 and fulfills the same function as the grooved drum 7 in FIG. 1.

The closure drum 96, drivable about the shaft 29 in the direction of arrow 30 synchronously with the grooved drum 72, has the same function as closure drum 31 in FIG. 1, namely that of completely wrapping with the connecting sheets the groups 21, transferred from the drum 72 already partially wrapped with connecting sheets, and of reliably gluing them by the application of an applied pressure acting over a fairly long period. The grooves 97 of the closure drum 96 serving this purpose are however formed differently from those of the drum 31 according to FIG. 1.

The grooves 97 are formed by the pressing surface regions 98 and the pressing surface regions 99. The centre points of the groove-shaped recesses, the pressing surface regions 98 and 99 of which define parts of the wall of a circular cylinder, lie upon the pitch circle 100. The pressing surface regions 98 consist, inside the pitch circle 100 of a part of a circular cylinder, which is adjoined outside the pitch circle by a radially extending flat surface. The circular cylindrical portion of the pressing surface region 98 extends beyond the center line 101, pointing towards the drum center 64, and thus constitutes the deepest position of the grooves 97. At the deepest postion of the grooves, radially extending passages 102 are situated symetrically to the center line 101, These passages 102 can be connected, via the passages 103 extending parallel to the central axis of the drum 96, to a vacuum or compressed air source as desired by means of a fixed control ring, not shown. Whereas the pressing surfaces 98 are realised by special shaping of the cylindrical surface of the drum 96, the cylindrical pressing surfaces 99 are shaped in tilting levers 105 (each associated with one groove 97), revolving with the drum. The tilting levers, pivotal about the pins 104, can be moved by means of the cams 106 by the radially movable plungers 107. The moving of the plungers 107 is effected by cam rollers, which are guided upon the cam path 117 of a fixed cam disc. The radially outwardly oriented movement of the cam rollers 108 always acts against the force of the prestressed compression springs 109, which act upon the tilting levers 105, so that the cam rollers always bear against the cam path 117. A bulge causes the grooves 97 to open, whereas a recess causes closure.

At the instant of transference of the groups 21 from the grooved drum 72 to the closure drum 96, the grooved drum 97 is opened. At this transference, the front ends 28 of the connecting sheets are already almost completely rolled around the groups by the rounded surfaces 110, without however actually being pressed on. By the suction applied to the passages 102 at the instant of transference, the groups are firmly held at the base of the groove-shaped recesses.

During the further trans-axial conveying of the groups 69, closing of the grooves is effected by a corresponding reduction of the radius of the cam path 117. This leads to a firm pressing of the pressing surfaces 99 of the tilting levers 105 against the overlap points of the connecting sheets and thus to reliable gluing.

The spoked or bladed drum 113, drivable about the shaft 111 in the direction of arrow 112 synchronously with the closure drum 96, has the same function as the removal drum 47 in FIG. 1, namely that of taking over the groups 69, completely surrounded by a connecting sheet and securely glued, and of conveying them for the purpose of further processing. The frame of the device is shown at 127 in FIG. 4.

The method of operating of the third form of embodiment is similar to that of FIG. 1. Differences lie in the following points:

The transference of the groups 21, partially wrapped in the grooved drum 72, into the closure drum 96 is effected, not by means of an ejector wheel, but by means of plungers driven by rollers, as has been described for the drum 72 in FIG. 3.

At the instant of transference of the groups 21 to the closure drum 96, the grooves 97 are in the state of maximum opening, thus facilitating the operation of entry. Holding of the groups to the drum 96 is effected by the passages 102 connected to a vacuum source. After the groups have been successfully transferred, the grooves are narrowed by a limited pivoting of the tilting levers 105, the pressing surfaces 99 exerting a defined pressure upon the overlap positions of the connecting sheets. In the region of approach to the spoked or bladed drum 113, the grooves are again widened by a limited pivoting motion of the tilting levers, in order to facilitate the forthcoming transference of the completely wrapped and glued groups 69 to the bladed drum 113.

The transference of the groups is promoted by switching off of the vacuum at the passages 102 and switching on of compressed air. Holding of the groups 69 in the cirlular-shaped grooves 114 of the blades 115 is effected by the suction holes 116, which can be connected by a control disc, not shown, to a vacuum source, also not shown.

In all the embodiments described, the groups are held so that the wrapped-around connecting sheet is pressed against the group over its entire surface, instead of only linearly, in the manner already known, and of doing this over a fairly long period; this period is determined by the rotational speed of the drums and by the angle as far as transference to the next transporting means anc can, when space requirements necessitate this, be prolonged by further drums.

Figure 4:
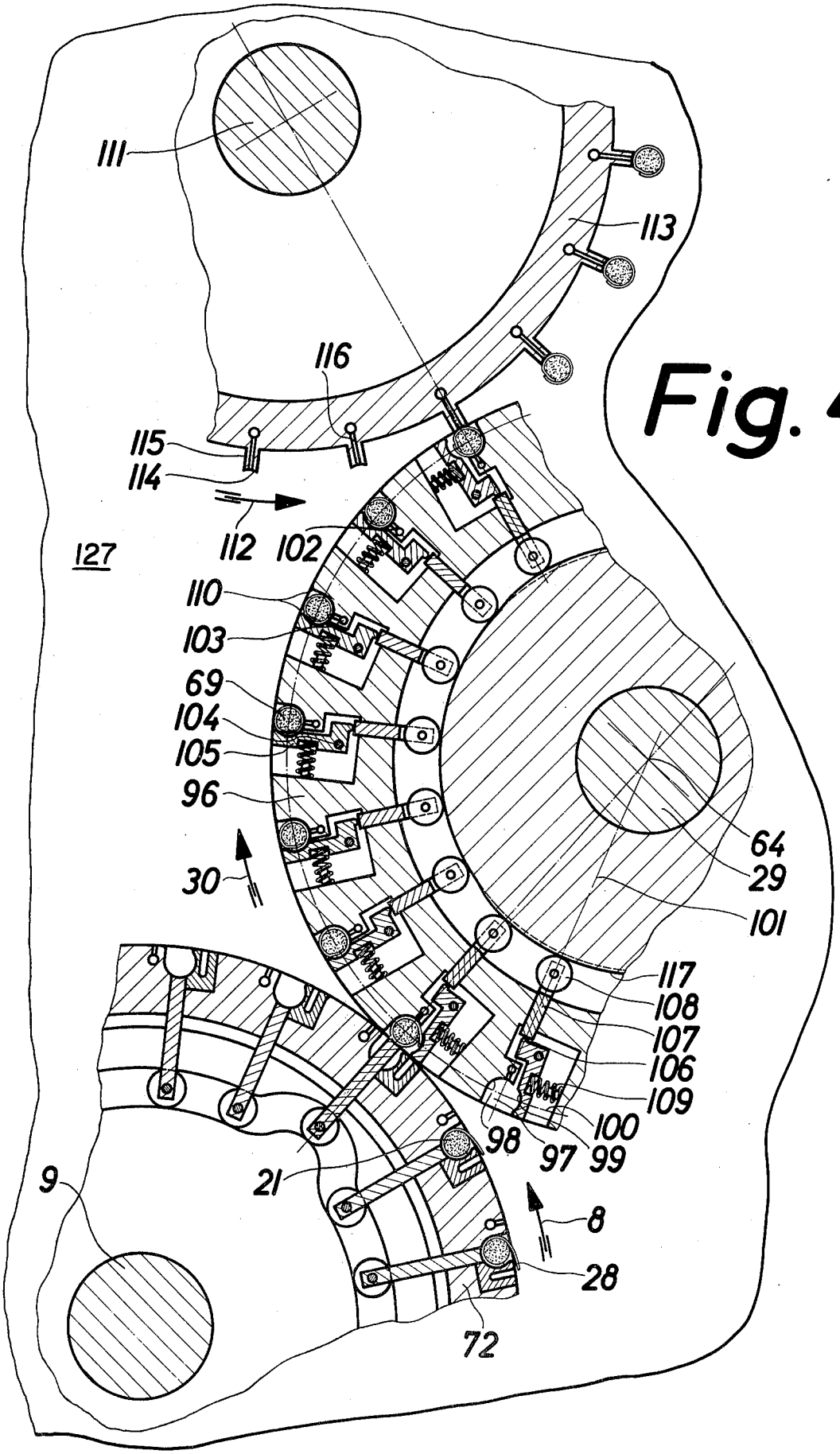
FIG. 4 shows part of a sectional view of part of a device for securing tip members to cigarettes in accordance with a third embodiment of the invention.

It will be understood that the invention is applicable not only to the manufacture of filter-tip cigarettes, but also to applications in which cardboard mouthpieces may be fitted, especially using the form of embodiment according to FIG. 4; furthermore, the cross-section of the grooves can be constructed for non-round, such as oval, shapes. Finally, the invention is also applicable to other problems, where rod-shaped objects are to be connected to one another end to end.

We claim:

1. A device for securing tips to rod-shaped articles, comprising in combination:- a frame;

a carrier drum rotatably mounted on said frame and adapted to carry a plurality of assemblies each comprising a tip component and two axially aligned rod-shaped articles disposed to abut against respective end surfaces of said tip component;

a grooved drum rotatably mounted on said frame and provided with a plurality of recess defining means disposed at intervals around the periphery of said grooved drum, each recess defining means defining a respective axially extending recess in the periphery of said grooved drum;

feeder means for feeding successive connecting sheets each provided with adhesive material on one surface thereof towards the peripheral surface of said grooved drum, each said connecting sheet being fed to overlie a respective one of said recesses with said one surface thereof facing outwardly of said grooved drum and with a portion of said connecting sheet, extending from a leading extremity of said recess on rotation of said drum, being longer than a portion of said connecting sheet extending from a trailing extremity of said recess;

urging means provided on said carrier drum to urge said assemblies carried by said carrier drum into said recesses in said grooved drum, whereby on said assembly being urged into the respective one of said recesses, said connecting sheet is partially wrapped around the periphery of said assembly and a free end portion of said connecting sheet is left outside of said recess at said leading extremity thereof;

vacuum means within said drum for initially holding said free end portion of said connecting sheet against the surface of said drum, guide means mounted on said frame in juxtaposed relationship with the periphery of said grooved drum, means for terminating the operation of said vacuum means before said free end portion reaches said guide means during the rotation of said drum, whereby said free end portion is released to extend outwardly from the surface of said drum, a stationary guide member provided on said guide means and disposed in a path traversed by said free end portion on rotation of said grooved drum, whereby said outwardly extending free end portion of said partially wrapped connecting sheet is deflected by said guide member whilst said assembly remains in said recess to cause said one surface of said free end portion to be disposed in mutually facing relatonship with said peripheral surface of said grooved drum;

ejector means operatively associated with said grooved drum to eject said partially wrapped assemblies from said recesses; and further carrier means displaceable in co-ordination with the rotation of said grooved drum and provided with a plurality of further recess defining means each defining a recess adapted to receive said partially wrapped assemblies ejected by said ejector means from said grooved drum, said further recess defining means being adapted to act on said free end portion of said connecting sheet to complete the wrapping of said connecting sheet around the periphery of said assembly.

2. A device as defined in claim 1, wherein said further carrier means comprises a closure drum mounted on said frame to be rotatable in coordination with said grooved drum.

3. A device as defined in claim 2, wherein said further recess defining means are disposed at intervals around the periphery of said closure drum, each said further recess defining means defining a respective axially extending recess in the periphery of said closure drum between two mutually facing surface portions of two clamping members, said mutually facing surface portions defining therebetween a substantially cylindrical portion of said recess and an inlet extending generally radially of said closure drum, said further recess defining means co-operating with displacement means to displace said two clamping members apart from one another to permit the passage of said assembly through said inlet and into said cylindrical portion of said recess and being resiliently urged towards one another to clamp said assembly therebetween.

4. A device as defined in claim 3, wherein said displacement means comprises a lever to impart pivotable displacement to at least one of said two clamping members.

5. A device as defined in claim 2, wherein said recesses defined by said recess defining means of said further drum are each defined between two mutually facing surface portions which are mutually spaced a fixed distance apart and which define therebetween a substantially cylindrical portion of said recess and an inlet extending generally radially of said further drum, said inlet being adapted to permit the passage of said assembly into said cylindrical portion of said recess and having a width dimension, which extends circumferentially of said grooved drum and which is less than the diameter of said cylindrical portion of said recess.

6. A device as defined in claim 2, wherein said recesses defined by said recess defining means of said further drum are each defined between two mutually facing surface portions of two members, said two members being resiliently biased towards one another and said mutually facing surface portions defining therebetween a substantially cylindrical portion of said recess and an inlet extending generally radially of said further drum, said inlet being adapted to permit the passage of said assembly into said cylindrical portion of said recess and having a width dimension which extends circumferntially of said further drum, the maximum value of said width dimension being less than the diameter of said cylindrical portion of said recess.

7. A device as defined in claim 2, wherein said recesses defined by said recess defining means of said further drum are each defined between two mutually facing surface portions of two clamping members, said mutually facing surface portions defining therebetween a substantially cylindrical portion of said recess and an inlet extending generally radially of said further drum, said recess defining means co-operating with displacement means to displace said two clamping members apart from one another to permit the passage of said assembly through said inlet and into said cylindrical portion of said recess and being resiliently urged towards one another to press said assembly therebetween.

8. A device as defined in claim 7, wherein said displacement means comprises a lever to impart pivotable displacement to at least one of said two clamping members.

9. A device as defined in claim 2, comprising further ejector means provided with a plurality of ejector blades and disposed in the interior of said further drum, each said recess defining means of said further drum defining a recess having a generally cylindrical portion communicating through a radially extending opening with the interior of said further drum, said openings co-operating with said ejector blades to permit said assemblies to be ejected from said recesses in said further drum.

10. A device as defined in claim 9, wherein said further ejector means comprises a member provided with a plurality of ejector blades projecting therefrom and rotatable in co-ordination with said further drum to permit said blades to pass through said openings to eject said assemblies from said recesses in said further drum.

11. A device as defined in claim 9, wherein each said ejector blade is operatively associated with a respective one of said recesses and is reciprocatably displaceable to eject said assembly from said respective recess.

12. a device as defined in claim 1, wherein said recesses defined by said recess defining means of said grooved drum are each defined between two mutually facing surface portions which are mutually spaced a fixed distance apart and which define therebetween a substantially cylindrical portion of said recess and an inlet extending generally radially of said grooved drum, said inlet being adapted to permit the passage of said assembly into said cylindrical portion of said recess and having a width dimension, which extends circumferentially of said grooved drum and which is less than the diameter of said cylindrical portion of said recess.

13. A device as defined in claim 1, wherein said recesses defined by said recess defining means of said grooved drum are each defined between two mutually facing surface portions of two members, said two members being resiliently biased towards one another and said mutually facing surface portions defining therebetween a substantially cylindrical portion of said recess and an inlet extending generally radially of said grooved drum, said inlet being adapted to permit the passage of said assembly into said cylindrical portion of said recess and having a width dimension which extends circumferentially of said grooved drum, the maximum value of said with dimension being less than the diameter of siad cylindrical portion of said recess.

14. A device as defined in claim 1, wherein said ejector means comprises a plurality of ejector blades disposed in the interior of said grooved drum, and wherein each said recess defining means of said grooved drum defines a recess having a generally cylindrical portion communicating through a radially extending opening with the interior of said grooved drum, said openings co-operating with said ejector blades to permit said assemblies to be ejected from said recesses in said grooved drum.

15. A device as defined in claim 14, wherein said ejector means comprises a member provided with a plurality of ejector blades projecting therefrom and rotatable in co-ordination with said grooved drum to permit said blades to pass through said openings to eject said assemblies from said recesses in said grooved drum.

16. A device as defined in claim 14, wherein each said ejector blade is operatively associated with a respective one of said recesses and is reciprocatably displaceable to eject said assembly from said respective recess.

17. A device as defined in claim 1, wherein said guide member is provided with means for applying suction to said free end portion to retain said free end portion in mutually spaced relationship with the peripheral surface of said grooved drum.

18. A device as defined in claim 1, wherein at least one of said grooved drum and said guide means is provided with heater means for applying heat to said connecting sheets for activating said adhesive material on said one surface of said connecting sheet.

19. A device as defined in claim 1, comprising an auxiliary drum provided with a plurality of recess defining means disposed at inervals around the periphery of said auxiliary drum, each recess defining means defining a respective axially extending recess in the periphery of said auxiliary drum, said auxiliary drum being rotatably mounted on said frame, disposed downstream of said further carrier means and adapted to receive said assemblies from said recess defining means of said further carrier means.

20. A device as defined in claim 1, wherein the wall member of said grooved drum is provided on each side of each said recess in the circumferential direction with passage means connectable in dependence upon the angular position of said grooved drum with one of a vacuum source and a pressure source, said passage means being selectively connected to said vacuum source for retaining said connecting sheet in contact with the peripheral surface of said grooved drum and being selectively connected to said pressure source to cause said free end portion of said connecting sheet to be displaced towards a postion in which said free end portion projects outwardly from said peripheral surface of said grooved drum.

* * * * *